US005906325A

United States Patent [19]

Harrison, Jr.

[11] Patent Number: 5,906,325

[45] Date of Patent: May 25, 1999

[54] SELF-SYNCHRONIZING PULLEY/WINCH APPARATUS AND OPERATING METHOD FOR CABLE HAVING ELECTRONIC OR OTHER PROTRUDING ELEMENTS SPACED ALONG ITS LENGTH

[75] Inventor: Earnest Roberts Harrison, Jr., Severna Park, Md.

[73] Assignee: Northrop Grumman Corporation, Los Angeles, Calif.

[21] Appl. No.: 08/951,926

[22] Filed: Oct. 16, 1997

[51] Int. Cl.[6] ..... B65H 51/12; B66D 1/26

[52] U.S. Cl. ..... 242/364.11; 242/365.6; 226/189; 254/295; 254/394; 254/407

[58] Field of Search ..... 242/364.2, 364.11, 242/364.9, 365.6, 470; 254/394, 407, 382, 295; 226/189

[56] References Cited

U.S. PATENT DOCUMENTS

| | | | |
|---|---|---|---|
| 893,906 | 7/1908 | Drake | 254/394 |
| 2,605,536 | 8/1952 | Litzler | 242/364.2 |
| 3,132,844 | 5/1964 | Gatlin et al. | 254/394 |
| 4,065,101 | 12/1977 | Korkut | 242/364.2 |

*Primary Examiner*—John M. Jillions

*Attorney, Agent, or Firm*—Walter G. Sutcliff

[57] ABSTRACT

A winch 100 is provided for taking up or paying out cable 13 without damaging protrusions 14 spaced along the cable from potentially high compressive forces applied to the cable when it is wound over drum members 16, 18, 20 of each of a pair of drum mechanisms 30A and 30B. The winch is operated so that the cable is pulled over the drum members and wound about the two drum mechanisms as a unit, such that successive cable protrusions are always maintained in successive cable path spaces between the drums of each drum mechanism.

17 Claims, 7 Drawing Sheets

FIG. 4
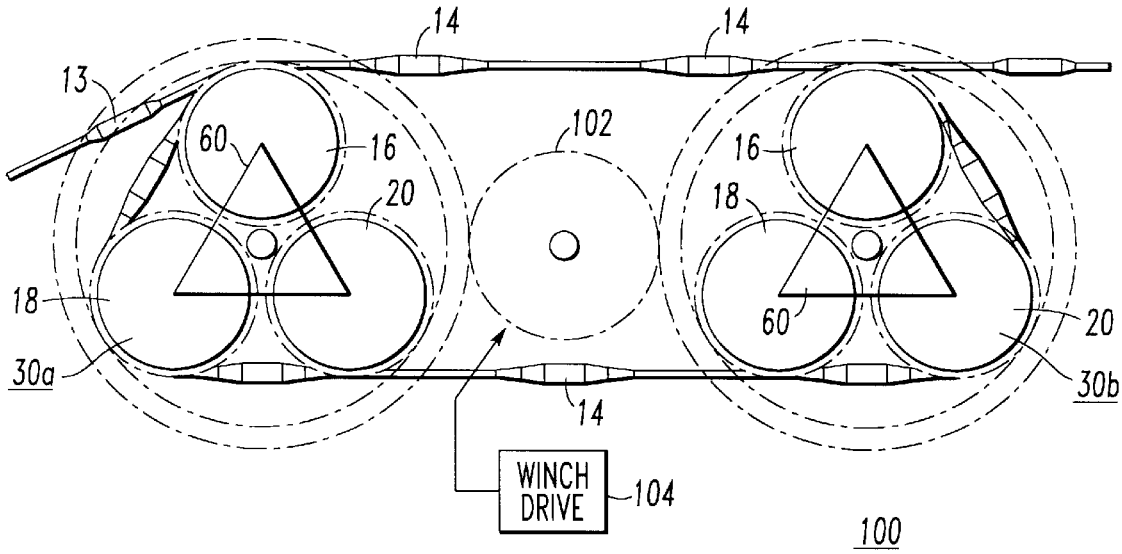
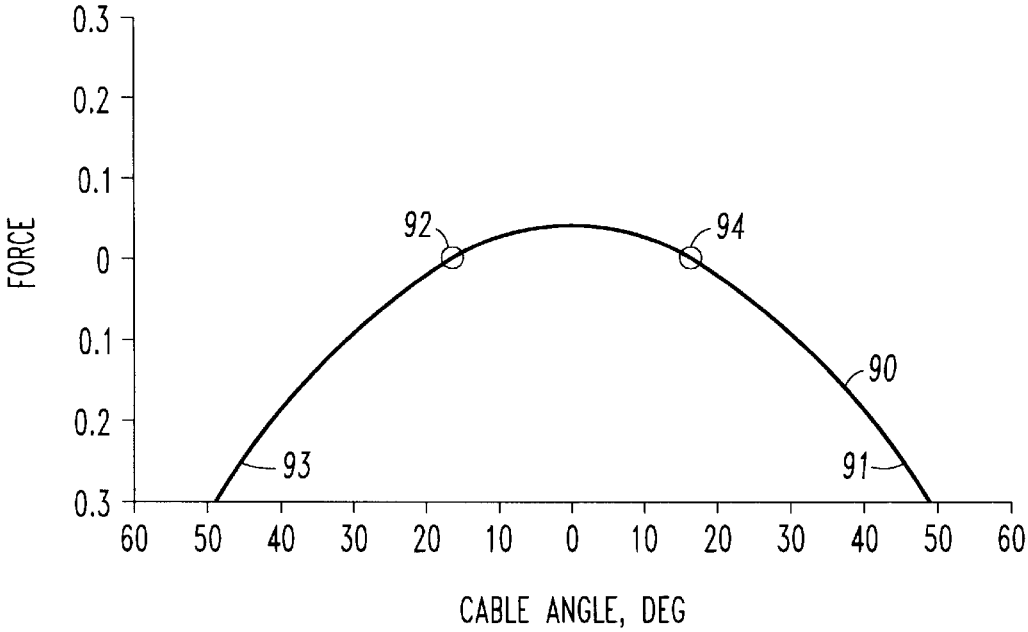
FIG. 5

SELF-SYNCHRONIZING PULLEY/WINCH APPARATUS AND OPERATING METHOD FOR CABLE HAVING ELECTRONIC OR OTHER PROTRUDING ELEMENTS SPACED ALONG ITS LENGTH

BACKGROUND OF THE INVENTION

The present invention relates to apparatus and methods for in-reeling and paying out cable having protruding elements along its length susceptible to damage from forces associated with pulling the cable and layering the cable as it is conveyed, and more particularly to self-synchronizing winch apparatus and methods arranged to in-reel or pay-out cable without damaging protruding elements carried by the cable.

Normally, cable, of the type under consideration, extends for a predetermined length, and has protruding elements spaced along its length typically at equal intervals. Such elements may be electronic elements which are externally connected through conductors within the cable.

Further, these protruding elements are most conveniently attached to an outer portion of the cable, thereby extending the "radius" of the cable to produce a protrusion or "lump." The cable, thus structured, carries equally spaced lumps along its length.

To avoid damage to the lumps during in-reeling, the in-reeling procedure must operate to reel the cable in without producing damaging forces against the lumps. Similar considerations apply to cable payout.

In the prior art, winches have typically used nonuniformities in applying in-reeling force to a line such as a chain, or simply applied in-reeling force to uniform line, such as a rope, without regard to any position on the line. These approaches do not even address the problems encountered in in-reeling a line with lumps.

SUMMARY OF THE INVENTION

The present invention is directed to an apparatus which may be structured to function as a winch which enables in-reeling or paying out of cable having spaced "lump" elements without damaging such lump elements. The apparatus can also be adapted to function as a pulley with similar benefits.

An apparatus is provided for taking up or paying out a cable having protrusions spaced along its length with the spaces between successive protrusions being equal to a predetermined value or a whole number multiple of the value. The apparatus comprises a drum mechanism having at least two drum members for cable takeup or payout. The drum members are spaced to provide cable path space between them at least equal to a longest of the cable protrusions.

First means supports the drum mechanism for rotation as a substantially rigid unit, and second means supports the drum members relative to the first supporting means for independent rotational motion of the drum members apart from rigid rotation of the drum mechanism as a unit.

Means are provided for driving the drum mechanism to rotate as a substantially rigid unit thereby pulling the cable over surfaces of the drum members while maintaining the successive cable protrusions in successive cable path spaces between the drum members, to impart independent rotative motion to the drum members as needed for takeup of cable stretch and/or slippage, and to deliver the cable to a takeup mechanism.

BRIEF DESCRIPTION OF THE DRAWINGS

The accompanying drawings, which are incorporated in and constitute a part of this specification, illustrate a preferred embodiment of the invention and together with the description provide an explanation of the objects, advantages and principles of the invention. In the drawings:

FIG. 4 is an end view of a winch apparatus having a pair of the cable mechanisms of FIG. 2 coupled together as a winch unit to enable multiple turns of high-tension cable to be wound on the drums before delivery at low tension to a takeup reel;

FIG. 5 is a graph illustrating the basis upon which motion of the the drum units of the cable mechanism shown in FIGS. 2 and 4 move as a unit or independently of each other;

DESCRIPTION OF THE INVENTION

The invention applies to taking up or paying out cable which has protrusions or lumps spaced, usually equally, along its length. The force required to take up the cable may be as high as 1000 to 3000 pounds or higher. The lumps can be supported on the cable with strain relief, or by other means, so that the tensile take-up force does not damage the lumps even though the lumps enclose electronic or other relatively fragile contents.

However, very heavy compressive force will crush the lumps if the lumps are pulled across the surface of a take-up mechanism such as a winch reel or a pulley wheel. Accordingly, the invention provides structure which can function as a cable take-up mechanism without subjecting the lumps to damaging forces.

A cable take-up mechanism of the invention has multiple lobes or drums which are disposed and cooperatively operated to take up cable, having lumps along its length, such that the cable and drum motions are synchronized to maintain successive lumps in space or spaces between the drums as the cable is taken up. As a result, the cable lumps move continuously during cable takeup to a take-up reel or the like, without being subjected to damaging compressive forces against the drums.

In a preferred winch embodiment of the invention, a winch apparatus includes a pair of rotating cable or drum mechanisms, each having three lobes or drums which provide traction to reel in a cable much like a winch does on a sailboat. Thus, a high tension end of the winch apparatus pulls the cable for winding on the drum mechanisms and then to a take-up reel at a low tension end of the winch. Some turns of the cable are wound on the drum mechanisms of the winch thereby enabling transitioning of the cable tension from the high entry value to the low outlet value.

The drums of each cable or drum mechanism are supported on the winch to rotate as a unit when cable take-up is occurring with the cable lumps entering the drum mechanism in successive spaces between the drums as the drums rotate as a unit. The drums are also individually rotatable to provide adjustments that may be needed in the positioning of the cable relative to the drums to avoid lump compression. In effect, the drums of each drum mechanism of the winch are synchronously operated with the moving cable lumps so that no damaging force is applied to the cable lumps by the drums during the reel-in process. Similar operation occurs with cable payout.

Figure 1:
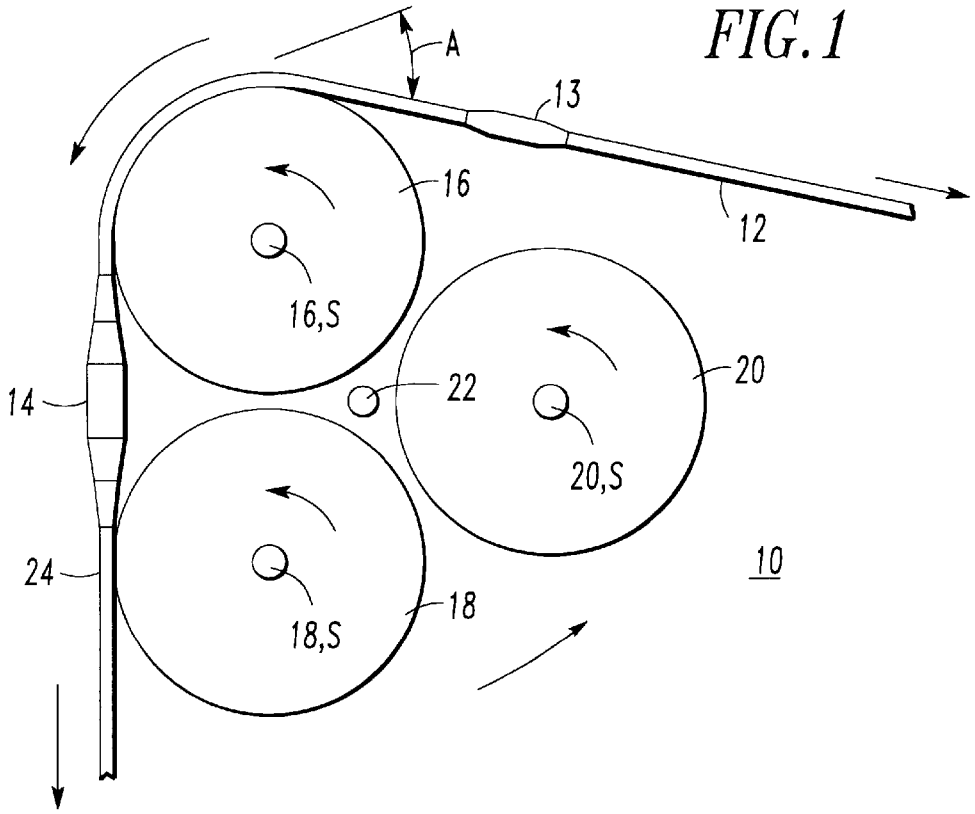
FIG. 1 is a schematic end view of a cable apparatus having multiple drum lobes and being adaptable for operation as a pulley without damaging the cable, where the cable has lumps spaced along its length.
Figure 8:
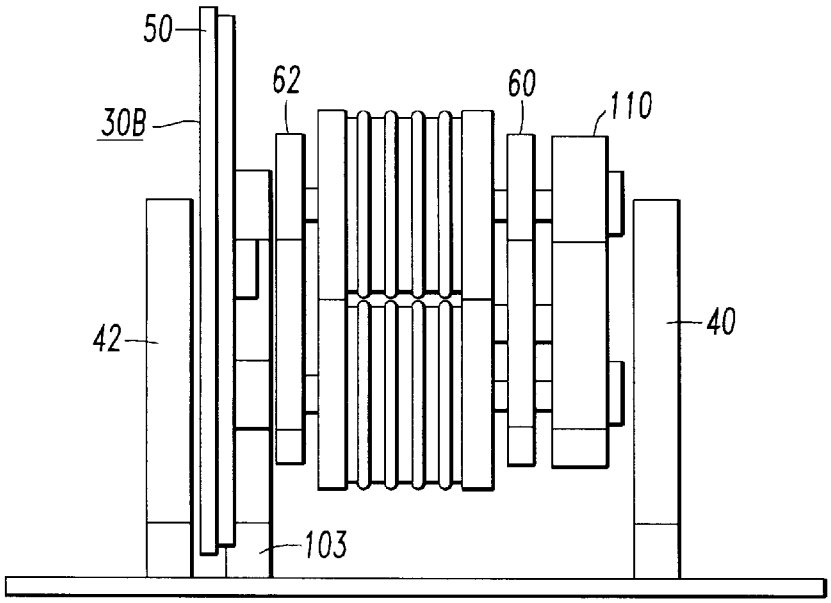
FIG. 8 is and end view of the winch unit of FIG. 4.

In FIG. 1, a cable apparatus 10 conceptually illustrates the invention. The apparatus 10 is structured to function as a pulley, which conveys a cable 12 having a predetermined thickness, such as 0.4 inches. The cable 12 has equally spaced, differently sized lumps 13, 14, and the pulley 10 takes in or pays out the cable 12 without applying compressive forces to the lumps 13, 14 which would otherwise damage electronic or other structure within the lumps 13, 14.

The cable 12 can include (details not shown) a strong polymer core member with surrounding optic fiber which carries digital signals to and from cable lump circuitry. An elastomer jacket can be provided as a cover for the cable. The lumps are units which can be positioned on, and secured to, the cable at portions where the outer jacket is removed. Appropriate circuit connections are made from optical/electronic circuitry in the lumps to the fibre optic circuitry in the cable.

The pulley 10 has multiple lobes or drums, preferably three drums 16, 18, and 20 which are supported (not specifically indicated in FIG. 1; see FIG. 2) for rotation as a unit about reference axis 22. The three drums can also move independently about respective supporting shafts 16S, 18S, and 20S.

After startup, the cable 12 enters the pulley 10 with high tension at an entry angle A, winds over the drums 16 and 18, and exits the pulley 10 for winding at low tension on a takeup reel as indicated by the reference character 24.

The drums 16, 18, and 20 rotate as a unit with successive lumps 13 and 14 continuously positioned, as shown, in the successive spaces located between the successive drums. The pulley drums thus rotate in unison or individually, as required, to orient the pulley 10 as though it were conveying a cable of uniform diameter along its length.

The pulley 10 accordingly applies takeup compressive forces substantially only to the cable portions on the drum surfaces, and applies no significant compressive forces and causes no damage to the lumps 13 and 14 during cable takeup (or, inversely, during cable payout).

Generally, the pulley 10 carries less than one turn of the cable and may be mechanically driven or manually operated. If the pulley 10 is driven, gearing including planetary gears may be employed as in the preferred winch embodiment of the invention now to be described.

Figure 2:
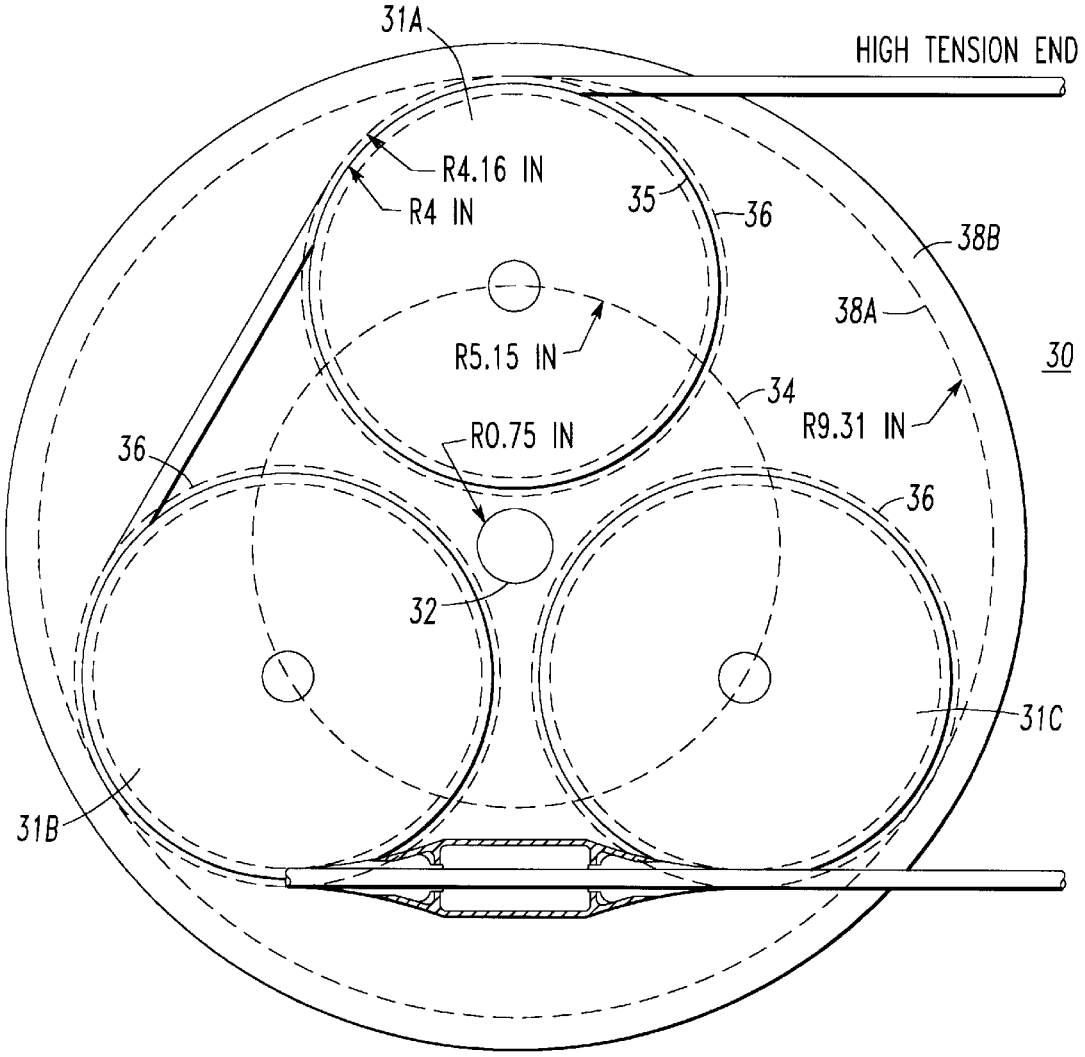
FIG. 2 is a schematic end view of a cable mechanism which is similar to the cable apparatus of FIG. 1, but which has a drum structure enabling it to operate as part of a winch apparatus.

A winch generally carries multiple cable turns during winding operations. The preferred embodiment of a winch drum mechanism 30 of the invention is shown in FIG. 2 with greater design detail than is shown for the pulley drum mechanism 10 of FIG. 1. In applying the invention, the details of winch design and cable design are developed together to enable invention operation as described herein.

The radii for various elements of the winch drum mechanism 30 are as shown in FIG. 2. These radii include the radius of a main drive shaft 32, the radius of a reference circle 34 through the centers of rotation of drums 31A, 32A, and 32C, the radius 35 of each drum, the radius of an outer periphery of a gear 36 of each drum, and the radius of an inner periphery 38A of a driving gear 38B. The periphery 38A also represents the outer path of rotation of the drums of the mechanism 30 when they rotate as a unit.

The gears 36 and 38 form a planetary gear group for driving the winch drum mechanism 30. The large outer gear 38B drives the drum gears 36 through the meshed gear teeth thereby allowing the mechanism 30 to impart tension to the cable.

Figure 3:
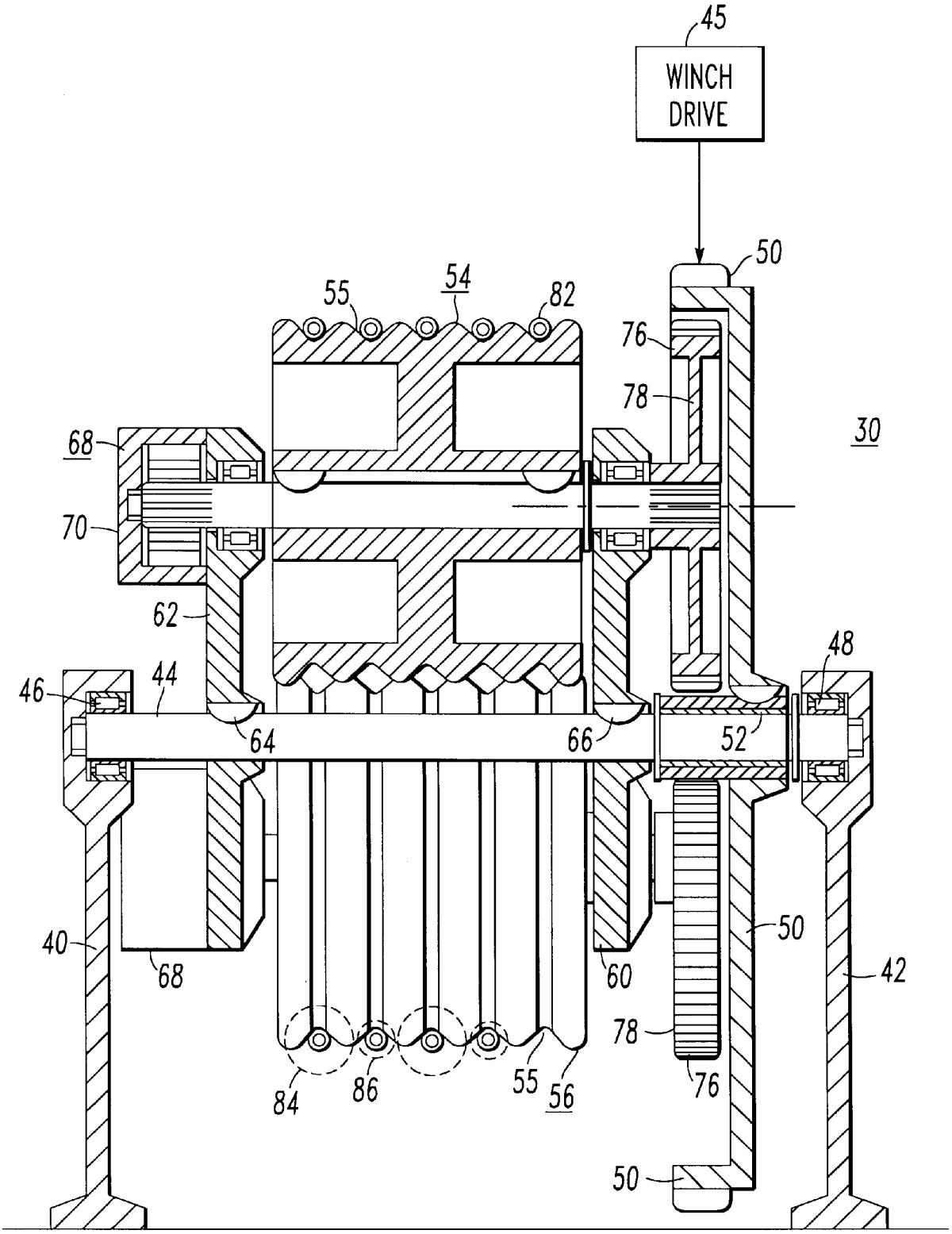
FIG. 3 is an enlarged, partially sectioned view of a drum unit employed in the winch cable mechanism of FIG. 2.

FIG. 3 is partially sectioned and illustrates the winch drum mechanism 30 in greater structural detail. Main bearing plates 40 and 42 support a shaft 44 through bearings 46 and 48. The shaft 44 operates as the center of winch mechanism rotation when the drums are rotated in unison.

Figure 6:
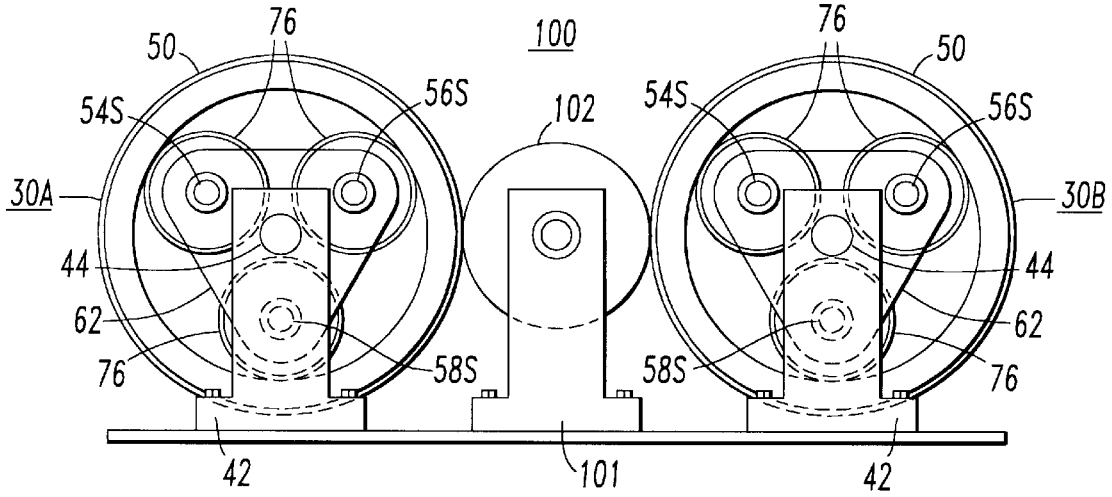
FIG. 6 is a front view of the winch unit shown in FIG. 4.
Figure 7:
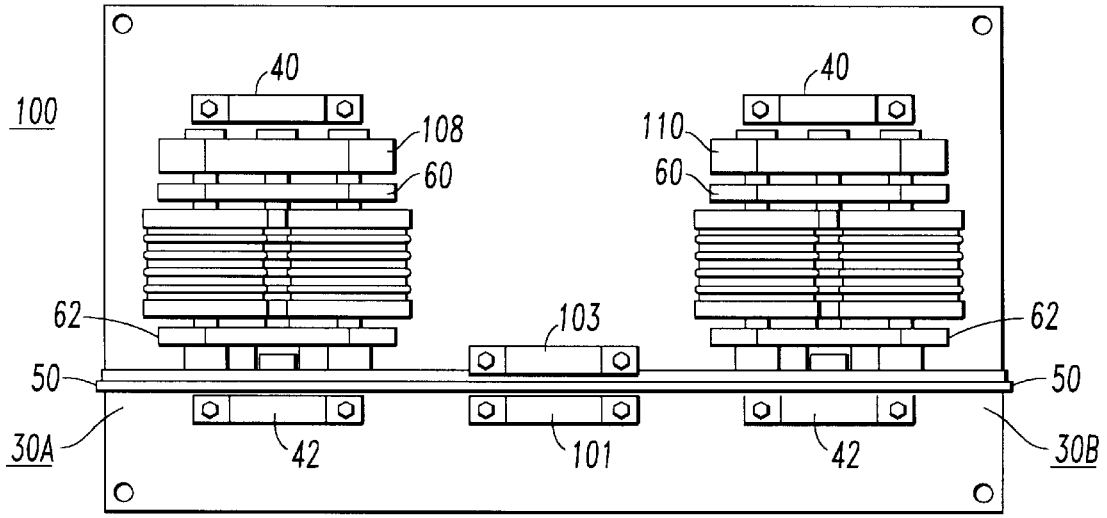
FIG. 7 is a top view of the winch unit of FIG. 4.
Figure 9A:
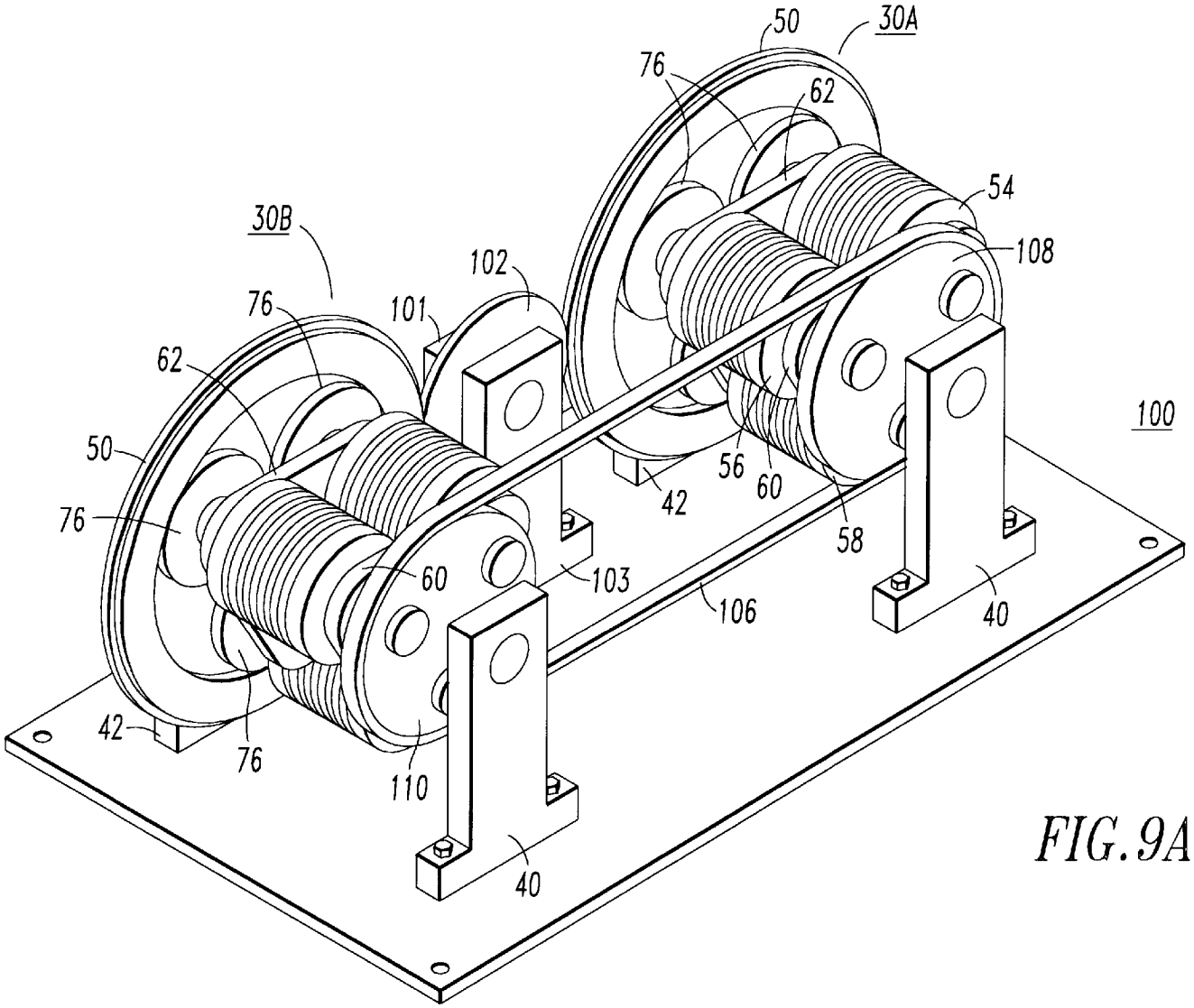
FIGS. 9A and 9B are complementary perspective views of the winch unit of FIG. 4.
Figure 9B:
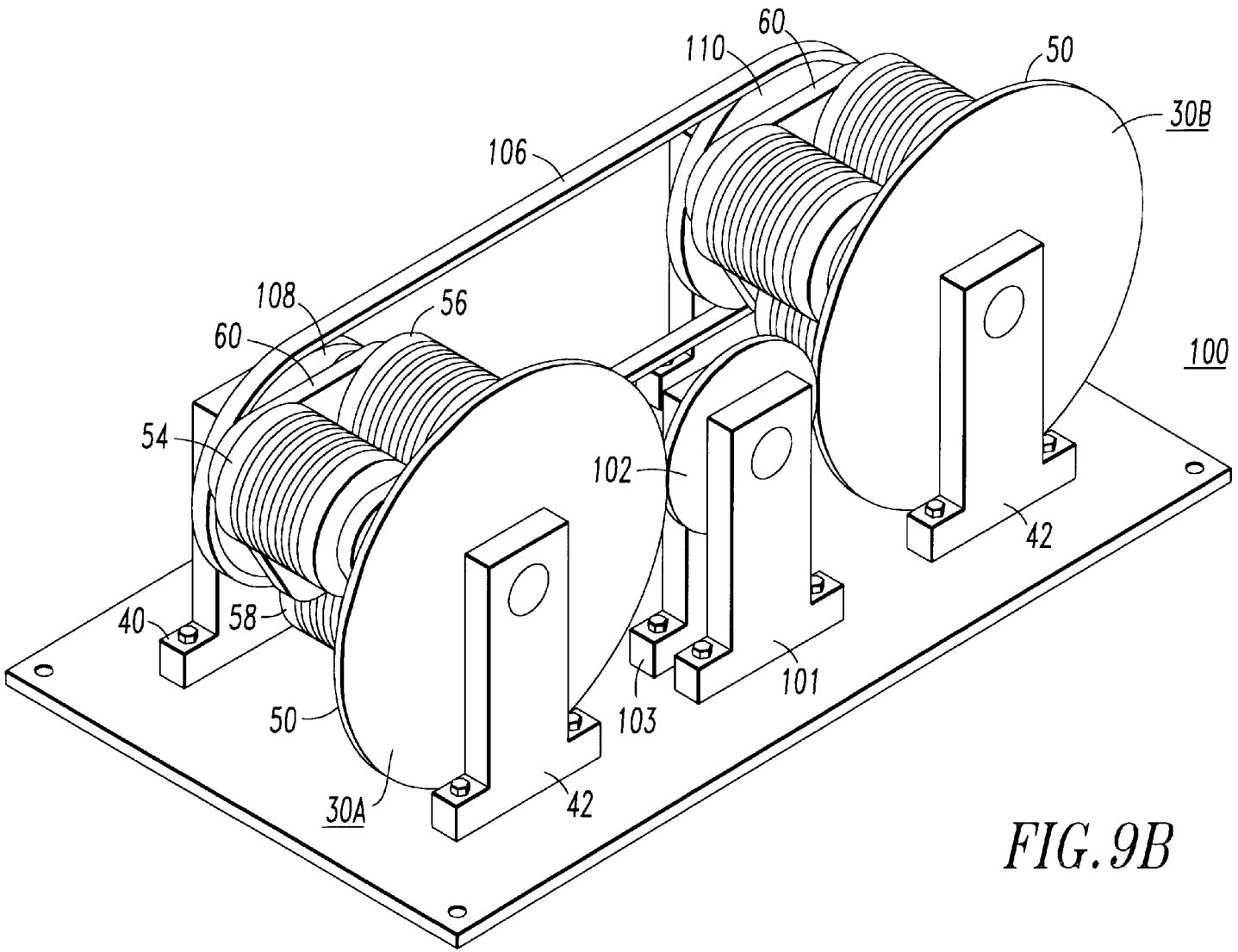

A circumferential driven gear 50 (corresponding to the gear 38B in FIG. 2) is supported on the shaft 44 through a bushing bearing 52 to drive drums 54 and 56 and 58 (FIGS. 9A and 9B). The drums are supported by respective shafts 54S, 56S, and 58S (FIG. 6) on triangular bearing plates 60 and 62 which, in turn, are supported on the main shaft 44 by keyed locking rings 64 and 66.

Each drum is preferably provided with a one-way slip clutch 68 or its equivalent (such as a dashpot—not shown), with a housing 70 of the clutch secured to the bearing plate 62. The slip clutch 68 prevents unwanted individual drum unit rotation toward the low-tension end of the winch otherwise caused by high cable pulling forces.

Each drum 54, 56, or 58 is provided with a planetary gear 78 supported on its shaft so that its outwardly facing teeth 76 mesh with inwardly facing, circumferential teeth of the driven circumferential gear 50. This gearing arrangement allows tension to be imparted to the cable as previously explained, and, further, allows the individual drums to turn independently, as needed, and to be tied together to turn as a winch unit when in-reeling or outpaying cable 82. In the latter case, the drums and the cable lumps have synchronized motion.

In this embodiment, five grooves 55 are provided on the outer surface of each drum to support five successive turns of the cable 82. Grooves are preferred because they provide side support for the cable as it moves over the drum surfaces. Each turn on the winch 10 reduces cable tension required from the takeup reel by about one fourth.

Dotted circles 84 and 86 indicate the outer diameter of lumps 14 and 13 if they were to be located on the drum instead of between successive drums as previously explained. This illustration provides a basis for realizing the damaging compressive forces which would be applied to the lump 14 without application of the invention.

The described planetary gearing is instrumental in determining the motion mode of the drums. In a unitary motion mode, the drums rotate rigidly as a unit driven by the gear 50. In a drum motion mode, the drums remain in place and rotate in response mainly to cable tension. The two motion modes can also occur simultaneously to produced mixed drum motions.

To achieve the described drum motions, the drum planetary gear 78 is larger than the drum diameter. Thus, with a uniform cable diameter between lumps, an equilibrium position exists where independent drum motion can occur.

In operation, a cable lump, preceded by a strain relief, causes the effective drum diameter to increase when the strain relief begins to ride up onto a drum. This action causes the drums to rotate rigidly together as a winch.

The graph in FIG. 5 is a plot 90 of unbalancing force on a drum (measured at the hub) as a fraction of gross cable tension against cable entry angle A FIG. 1). The angle A is zero for a reference line tangent to the apex of the drum. The angle A in FIG. 1 is positive since the winding direction is referenced as the positive direction.

When the plotted force ratio is positive, the drums turn toward the high tension end of the cable. Conversely, when the plotted force ratio is negative, the drums turn toward the low tension end of the winch.

Two equilibrium points 92 and 94 exist on the plot 90. The equilibrium point 92 is a stable equilibrium point where independent drum motion occurs as described above. As the cable is reeled in or payed out, the winch passes through the stable equilibrium point 92 three times per cable turn, i.e., per revolution of the gear 50.

When this happens, the drums move gently toward the high-tension end of the cable, thereby acquiring slightly more cable. This motion is stopped by the cable strain reliefs. The winch thus can take up slippage and stretch while remaining synchronized. In effect, the drums rotate as a nearly rigid group except for slip and stretch of the cable.

Rigid drum mechanism rotation and mechanism motion where the drums barely move about their axes combine to cause the total motion computed and plotted in FIG. 5. Peak force is adjustable by changing the ratio of the radius of the planetary drum gear to the radius of the drum. In the stable equilibrium state, the force on any wound lump is 4% or less of the high cable tension force.

The equilibrium point 94 is unstable and also occurs three times per cable turn, i.e., one revolution of the gear 50. If and as the unstable equilibrium point 94 is passed, the drums tend to turn away from the high tension end of the cable. The one-way slip clutch 68 of FIG. 3 prevents this drum motion and thereby prevents uncontrolled motion of the drums along a downward right side 91 of the plot 90 and then back up an upward left side 93 of the plot 90.

In the graph of FIG. 5, the plot 90 moves downward causing the equilibrium points 92 and 94 to move together as a lump begins to ride up on a drum. If this condition were to persist, the plot 90 would drop completely into the negative region with the drums moving toward the low tension end of the cable. As indicated, the slip clutch prevents this from happening.

The preferred invention embodiment, as a whole, is shown in FIGS. 6–9A, 9B. A winch apparatus 100 include a pair of drum mechanisms 30, i.e., 30A and 30B, coupled together through an idler 102 which is supported by bearing plates 101 and 103. In this case, the mechanism 30A is driven by a winch drive 104 through the idler 102. Like reference characters are employed for like elements in FIGS. 2, 3, and 6–9A, 9B as appropriate. The winch apparatus in FIGS. 6–9A, 9B is arranged to facililtate lateral movement of the cable across the drum surfaces as successive cable turns are wound about the drums. The winch mechanisms 30A and 30B are separated by a suitable distance which enables reliable winding of the cable with successive cable turns being led into successive paired grooves of the drums 30A and 30B. One of the winch mechanisms 30A or 30B is set forward relative to the other winch drum mechanism, preferably by one/half of the cable pitch, to enable smooth flow of the cable as it is wound into successive grooves from one winch drum mechanism to the next in forming cable turns about the winch.

As shown in FIGS. 9A, 9B the winch 100 preferably includes a timing belt 106 linking pulleys 108 and 110 of the winches 30A and 30B. The timing belt 106 maintains equal angular alignments of the mechanisms 30A and 30B so that the distance around the cable path is constant independent of the angle of 30A and 30B.

In the overall operation of the paired winch 100, the winch begins to turn as a unit during startup of an in-reeling operation. When the first cable lump reaches the first drum, that drum begins to turn independently as previously described as the strain relief of the lump begins to ride up onto the drum. The first lump is thus retained in the space between that drum and the next drum in the winch unit rotation. If desired, a precursor or dummy lump can be installed as the first cable lump to provide additional protection against damage to operating lumps during the winch startup process.

The winch next turns with the drums moving as a rigid unit until the next cable lump is reached by the next or a subsequent drum in the rotation. The next drum also moves independently to keep the new lump in its inter-drum space. This synchronous process continues until all cable turns are wound on the winch with the low tension end of the cable being conveyed to the takeup reel.

The foregoing description of the preferred embodiment has been presented to illustrate the invention. It is not intended to be exhaustive or to limit the invention to the form disclosed. In applying the invention, modifications and variations can be made by those skilled in the pertaining art without departing from the scope and spirit of the invention. It is intended that the scope of the invention be defined by the claims appended hereto, and their equivalents.

What is claimed is:

1. An apparatus for taking up or paying out a cable having protrusions spaced along its length, the spaces between successive protrusions being equal to a predetermined value or a whole number multiple of the value, the apparatus comprising:

a drum mechanism having at least two drum members for cable takeup or payout; the drum members being spaced to provide cable path space between them at least equal to a longest of the cable protrusions;

first means for supporting the drum mechanism for rotation as a substantially rigid unit;

second means for supporting the drum members relative to the first supporting means for independent rotational motion of the drum members apart from rigid rotation of the drum mechanism as a unit; and means for driving the drum mechanism to rotate as a substantially rigid unit to pull the cable over surfaces of the drum members while maintaining the successive cable protrusions in successive cable path spaces between the drum members and applying takeup or payout forces only to cable portions between the cable protrusions, to impart independent rotative motion to the drum members as needed for takeup of cable stretch and/or slippage, and to deliver the cable to a takeup mechanism.

2. The cable apparatus of claim 1 wherein the drum mechanism has at least three drum members with the defined cable path space provided between first and second drum members, between the second and third drum members, and between the third and the first drum members.

3. The cable apparatus of claim 1 wherein the apparatus is a pulley and wherein at least two drum members carry less than one cable turn during pulley operation.

4. The cable apparatus of claim 1 wherein the drum members have drum surfaces over which multiple turns of the cable can be wound for winch operation.

5. The cable apparatus of claim 1 wherein multiple side-by-side circumferential grooves are provided about each drum surface to hold successive cable turns with side support.

6. The cable apparatus of claim 4 wherein the cable apparatus is a winch and another drum mechanism is provided as part of the winch, the two drum mechanisms having substantially identical structures and being positioned relative to each other to enable winding of successive cable turns across the drum member surfaces thereof.

7. The cable apparatus of claim 6 wherein multiple side-by-side grooves are provided about each drum surface of each drum mechanism to hold successive cable turns with side support, each cable turn extending from one of the drum mechanisms to the other drum mechanism and back to the one drum mechanism.

8. The cable apparatus of claim 1 wherein the respective drum members have respective drum gears, and the driving means includes the drum gears and a driving gear which is meshed with the drum gears.

9. The cable apparatus of claim 8 wherein the driving gear has a radius greater than a radius of the drum mechanism.

10. The cable apparatus of claim 6 wherein the driving gear has a radius greater than a radius of the drum mechanism.

11. The cable apparatus of claim 1 wherein the driving means includes a slip clutch for controllilng independent motion of each drum member to take up cable stretch and/or slippage.

12. The cable apparatus of claim 6 wherein:

the first supporting means of each drum mechanism includes a unit shaft supported for rotation by a pair of first bearing plate members; respective drum shafts supporting the drum members; and a pair of second bearing plates supported by the unit shaft and, in turn, supporting for rotation respective drum member shafts.

13. The cable apparatus of claim 12 wherein the respective drum members have respective drum gears, and the driving means includes, for each drum mechanism, the drum gears and a driving gear which is supported by the unit shaft and is meshed with the drum gears.

14. The cable apparatus of claim 13 wherein the driving means further includes an idler operating under drive power to drive the driving gears.

15. The cable apparatus of claim 6 wherein a slip clutch is coupled to each of the drum shafts to control independent motion of the drum members for taking up cable stretch and/or slippage.

16. A method for operating a cable apparatus to take up or pay out cable having protrusions spaced along its length, the spaces between successive protrusions being equal to a predetermined value or a whole number multiple of the value, the steps of the method comprising:

rotating a drum mechanism as a substantially rigid unit, the drum mechanism having at least two drum members for cable takeup or payout; the drum members being spaced to provide cable path space between them at least equal to a longest of the cable protrusions;

rotatively moving each drum member independently of the rotation of the drum mechanism as a unit; and driving the drum mechanism to rotate as a substantially rigid unit to pull the cable over surfaces of the drum members while maintaining the successive cable protrusions in successive cable path spaces between the drum members, and applying takeup or payout forces only to cable portions between the cable protrusions to impart independent rotative motion to the drum members as needed for takeup of cable stretch and/or slippage, and to deliver the cable to a takeup mechanism.

17. The method of claim 16 wherein the cable apparatus is a winch and another drum mechanism is provided as part of the winch, the two drum mechanisms having substantially identical structures and being positioned relative to each other to enable winding of successive cable turns across the drum member surfaces thereof, and wherein:

the drum mechanism rotating step includes operating a drive gear for each drum mechanism to drive the drum members thereof through respective drum gears of the respective drum members, the radius of the drive gears being larger than the radius of the respective drum mechanisms.

* * * * *